United States Patent [19]

McHenry

[11] 4,294,879

[45] Oct. 13, 1981

[54] FIBROUS INSULATION MAT WITH ANTI-PUNKING BINDER SYSTEM

[75] Inventor: Patricia A. McHenry, Denver, Colo.

[73] Assignee: Johns-Manville Corporation, Denver, Colo.

[21] Appl. No.: 212,928

[22] Filed: Dec. 4, 1980

[51] Int. Cl.[3] ..... D04H 1/58

[52] U.S. Cl. ..... 428/288; 260/29.3; 260/38; 427/389.8; 428/290; 428/429; 428/447; 525/489

[58] Field of Search ..... 427/389.8; 525/489; 260/29.3, 38; 428/288, 290, 429, 447

[56] References Cited

U.S. PATENT DOCUMENTS

| | | | |
|---|---|---|---|
| 3,072,595 | 1/1963 | Barth et al. | 260/29.3 |
| 3,846,225 | 11/1974 | Stategro | 428/392 |
| 3,911,046 | 10/1975 | Ackermann et al. | 260/29.3 |
| 3,956,204 | 5/1976 | Higgenbottom | 260/29.3 |
| 4,251,590 | 2/1981 | Rubright et al. | 428/288 |

*Primary Examiner*—James J. Bell

*Attorney, Agent, or Firm*—Robert M. Krone; Joseph J. Kelly

[57] ABSTRACT

The present invention comprises a low-cost, convenient to use anti-punking binder system for use in bonding entangled masses of mineral fibers such as glass. The binder system comprises a phenolic-formaldehyde resin mixed with a water soluble urea-formaldehyde resin; the urea-formaldehyde resin content in the binder system comprising an amount of about 5 to 50% by weight of the binder solids content. The urea-formaldehyde resin comprises about 59% urea, about 19% formaldehyde and about 22% water by weight. Silane, ammonia and ammonium sulfate may also be added.

5 Claims, No Drawings

FIBROUS INSULATION MAT WITH ANTI-PUNKING BINDER SYSTEM

TECHNICAL FIELD

This invention relates to fibrous insulations and more particularly to fibrous insulations bonded with a binder having antipunking characteristics achievable at low cost.

BACKGROUND OF PRIOR ART

Glass fibers have long been noted for their insulating value. However, depending upon the end use of the insulation there are disadvantages to be found in glass fiber insulation now in general use.

It is characterisitc of fibrous insulation that the respective fibers are bonded to one another by a suitable binder system which normally consists of a phenolic liquid resole resin or a conventional phenolic-formaldehyde resin in combination with various additives. These additives are used to improve either the process characteristics of the binder system or to improve the finished fiber glass product characteristics. The resole resins may be made by partial condensation of a phenol with a molar excess of an aldehyde in alkaline solution. In most cases the type of resole used in one prepared by condensing about one mole of phenol with about 2.0 to 3.0 moles of formaldehyde. An alkaline catalyst may be used and may comprise any water soluble alkali metal hydroxide or alkali earth compound. Catalysts such as sodium hydroxide, sodium carbonate, calcium hydroxide and barium hydroxide have been successfully employed.

This type of organic liquid resole resin when applied to a fiber glass mass or an insulation in concentrations of 1 to 20% of the total mass, is readily susceptible to flameless combustion or "punking" when exposed to temperatures in excess of 425° F. (209.5° C.). Punking, of course, is a term of art used to denote the comparatively rapid flameless oxidation of the binder with a concomittant generation of heat. Odors and fumes given off by such thermal decomposition are offensive, potentially hazardous and are capable of discoloring and staining adjacent materials. Furthermore, punking may be associated with exothermic reactions which increase temperatures through the thickness of the insulation causing a fusing or devitrification of the glass fibers and possibly creating a fire hazard. Once devitrification has occurred the insulation is usually incapable of thermally insulating an associated object and may warp and pull away from the very object it was intended to insulate. Furthermore, devitrification of the glass fibers causes the fiber glass product to lose its structural integrity to the extent that the vibrations and impacts occurring during normal usage may cause dusting problems. In an extreme case the normal vibrations and impacts may dislodge the insulation causing it to become a personal safety hazard in the working environment.

In an effort to reduce punking the art has attempted to increase the punk resistance of the binder systems used and to more nearly align the properties of the binder system with the properties of the glass fiber by reacting nitrogenous substances such as melamine, dicyandiamide, urea, thiourea, biurea, guanidine and similar compounds with phenol-aldehyde partial condensation products of the resole type. Although the incorporation of such nitrogenous compounds improves the punk resistance and overall thermal stability of the binder system, products composed of glass fibers in association with such binder systems are still not suitable for use in environments approaching the limits of the heat stability of the glass fiber itself.

Commercially available "anti-punk" phenolic-formaldehyde resins containing additives such as dicyandiamide, melamine, urea or combinations thereof, which are co-reacted at the time of resin manufacture, possess satisfactory "anti-punk" properties but generally lack stability during storage in comparison to a conventional phenolicformaldehyde resin, e.g., certain components precipitate out of the resin solution or water dilutability is lost during storage. Both these reductions in stability increase production difficulties. Also, it is inconvenient to store anti-punk resins for fibrous products requiring same and to separately store conventional phenolicformaldehyde resins for products not requiring anti-punk characteristics. Finally, the cost of commercially available anti-punk phenolic-formaldehyde resins has increased dramatically in recent years thereby reducing its attractiveness.

The addition of anti-punk ingredients to a conventional phenolic-formaldehyde resin by a fiber glass manufacturer just prior to production use would make the anti-punk binder more flexible in processing and more economical. The manufacturer would be able to add the optimal amount of anti-punk ingredient that would satisfy the needs of a specific product; the need depending on the use of the finished product. Also by adding the anti-punk ingredient to a conventional phenolic-formaldehyde resin the fiber glass manufacturer has more choices in what resin to purchase as there are many more conventional resins commercially available than anti-punk resins. This broader purchasing range gives the manufacturer an economic advantage. Conventional phenolic-formaldehyde resins, for example, are traditionally lower cost than anti-punk phenolic-formaldehyde resin. Therefore if a low cost anti-punk ingredient is used in the binder system, the anti-punk binder system would be lower in cost overall.

The addition of the nitrogen containing compounds after the resin manufacture is often hampered by the handling characteristics of the nitrogen containing compounds. Urea, although readily water soluble and economical, when added to a binder system containing a standard commercially available liquid resole thermal insulation resin, presents a potential emission problem due to the high volatility of urea. Melamine and/or dicyandiamide combinations are expensive to purchase and pose post-resin manufacture addition problems such as stability.

It is imperative that any binder system satisfy not only the anti-punking requirement but also satisfy the other product requirements, for example, many products must possess moisture resistance and compressive strength.

There thus exists a need for an economical and relatively simple way to impart "anti-punk" properties to a conventional phenolic resole resin thereby avoiding the impediments cited above.

BRIEF SUMMARY OF THE INVENTION

An object of the invention is to provide fibrous insulations formed by glass fibers bonded together with a low cost, stable and low emission pollutant anti-punking binder system which is convenient to use, and satisfies the other product requirements of the insulation.

These and other objects of the present invention are attained through the manufacture of glass fibers bonded with a binder system comprising a conventional phenolic-formaldehyde resin and a conventional urea-formaldehyde "anti-punk" ingredient or resin. The urea-formaldehyde anti-punk ingredient comprises about 59% urea, about 19% formaldehyde and about 22% water and is added to the conventional phenolic-formaldehyde resin in an amount of 5 to 50% by weight of the binder solids content. Ammonia, silane and ammonium sulfate are additives which also may be added to the anti-punk binder system.

The method of application of the binder system to the fibrous insulation comprises mixing the phenolic-formaldehyde resin and the urea-formaldehyde anti-punk ingredient at the time of use as compared to forming an anti-punk resin through a reaction of a phenolicformaldehyde resin and an anti-punk ingredient. Mixing only at the time of use allows the phenolic-formaldehyde resin to be used not only in combination with the urea-formaldehyde resin, which imparts antipunking properties, but alone one fibrous insulation not requiring antipunk properties. Further, separate storage and subsequent mixing of the phenolic-formaldehyde resin and the urea-formaldehyde resin allows an optimization of the mixing proportions for a particular product. Binder system storage therefore is solely dependent on the shortest storage life of the subcomponents. Finally, the method of mixing of the components of the anti-punk binder system has been found to be important for long term stability of the binder system.

At the time of use the conventional phenolic-formaldehyde resin and the conventional urea-formaldehyde anti-punk ingredient and additives, mixed in the proper sequence, are combined and the binder system is sprayed onto fibers after they have been formed in a conventional fiber forming process thereby producing a fibrous insulation product having satisfactory anti-punk resistance at a lower cost than conventional anti-punk resins. This binder system has been found to satisfy all moisture resistant requirements and has produced superior compression strength over binder systems utilizing anti-punk phenolic-formaldehyde resins.

DETAILED DESCRIPTION OF INVENTION

The insulation suitable for use with the present anti-punk binder system can be made by any of the different techniques well known in the art of making mineral or glass fibrous insulation. The binder system of the present invention may be applied to fibers after they are formed, as is conventional.

The basic binder system mix of the present invention comprises the use of any conventional water soluble phenolicformaldehyde resin such as a resin known in the trade as "Tybon 951-3" resin sold by Pacific Resin & Chemicals, Inc. Preferably the range of total solids in the final insulation product lies between about 1 to 20% loss-on-ignition (LOI) which is, of course, related to the total weight (and weight in naturally related to the density) of the fiber glass in the product. More preferably the range of total solids in the final insulation product lies between about 2 to 12% LOI. Total solids is defined herein as the combination of binder solids and additive solids. In the present invention the binder solids are derived from the phenolic resin and the urea-formaldehyde resin described hereinafter. Additive solids are derived from ammonium sulfate and silane if they are added to the binder system, as will be explained.

To this conventional phenolic-formaldehyde resin is mixed a conventional water soluble urea-formaldehyde resin. The ureaformaldehyde resin content in the total binder mix comprises an amount of about 5 to 50% by weight of the binder solids content and preferably comprises an amount of about 20 to 30% by weight of the binder solids content and most preferably comprises an amount of 27% by weight of the binder solids content. The urea-formaldehyde resin found useful in the present invention is a resin known in the trade as "GP-5340" sold by the Georgia Pacific Corporation. This commercially available ureaformaldehyde resin has been calculated to comprise about 59% urea, about 19% formaldehyde and about 22% water by weight.

Fibrous insulation bonded with the present binder system mix has been found satisfactory up to 850° F. use temperature at about 3 to 5% LOI.

Optionally and preferably, additives such as commercially available silane may be added to the binder system in order to impart moisture resistance to the fiber glass product, if needed. The silane content in the binder system mix is preferably about 0.1 to 0.4% by weight based on the binder solids and most preferably between about .2 to 0.36% by weight based on the binder solids. Ammonia, in industrial grades, may be added to the binder system mix in an amount of about 0 to 30% by weight based on the binder solids in order to increase the stability of the binder system, i.e., prevent precipitation of compounds added to the system. Finally, ammonium sulfate which acts as a curing catalyst may be added to the binder system mix in order to aid thermosetting of the binder system as it bonds the interentagled glass fibers together thereby forming an insulating mass. The ammonium sulfate may be added to an amount between about 0 to 6% by weight of the binder solids.

A specific example of the basic binder system formulation used for fibrous insulation in the present invention is illustrated below.

EXAMPLE I

| Material | % By Weight | |
|---|---|---|
| Phenolic-formaldehyde resin solids | 73 | |
| Urea-formaldehyde resin solids | 27 | |
| Ammonia | 20 | Based on binder solids, where binder solids are solids contributed from the phenolic-formaldehyde resin and from the urea-formaldehyde resin, as was defined earlier. |
| Ammonium sulfate | 4 | |
| Silane | .36 | |

The mixing sequence or method of mixing the binder system has been found to be important with the critical feature being that the ammonia must be added before the ammonium sulfate. If the ammonium sulfate is added before the ammonia, precipitation of binder components may take place.

This binder system, when prepared and applied as previously described also imparts adequate moisture resistance and compressive strength to produced fiber glass products. For example, a fiber board insulation product made for hull insulation aboard ships, known in the trade as "Hullboard," and sold by Johns-Manville Corporation, has improved compressive strength when made with Example I, compared to when the product is made with binders containing anti-punk phenolicformaldehyde resins. When the product is produced with a binder system containing an anti-punk phenolic-formaldehyde resin, an LOI of 8% is required for the product to meet a compressive strength requirement of 200 psf (pounds per square foot) when tested according to the Military Test Specification, MIL-I-742A. When the "Hullboard" product is produced using the aforedescribed binder system an LOI of only 6% is necessary to satisfy the military specification. In this example the improved compressive strength can be translated to a decrease in binder usage thereby reducing the cost to produce "Hullboard" insulation. In other cases the improved compressive strength is realized as is, i.e., a product improvement.

What is claimed and desired to be secured by Letters Patent of the United States is:

1. Fibrous insulation comprising a mass of glass fibers bonded with a binder system in an amount which lies between about 1 to 20% loss-on-ignition, said binder comprising a water soluble phenolicformaldehyde resin mixed with a water soluble urea-formaldehyde resin, the urea-formaldehyde resin content in said binder system comprising an amount of about 5 to 50% by weight of the binder solids content, said urea-formaldehyde resin comprising about 59% urea, about 19% formaldehyde and about 22% water by weight.

2. The insulation of claim 1, wherein the urea-formaldehyde resin content in said binder comprises an amount of about 27% by weight of the solids content in said phenolic-formaldehyde resin.

3. The insulation of claims 1 or 2, wherein said binder system further comprises silane in an amount about .1 to 4% by weight based on the binder solids, ammonia in an amount of about 0 to 30% by weight based on the binder solids content and ammonium sulfate in an amount between about 0 to 6% by weight based on binder solids.

4. A process for mixing an anti-punk binder system and using it for bonding mineral fibers into an insulating mass, comprising: mixing said binder system by mixing a water soluble phenolicformaldehyde resin with a water soluble urea-formaldehyde resin, the urea-formaldehyde resin content in said binder system comprising an amount of about 5 to 50% by weight of the binder solids content, said urea-formaldehyde comprising about 59% urea, about 19% formaldehyde and about 22% water by weight, said method further comprising adding silane in an amount between about .1 to .4% by weight based on the binder solids, adding ammonia in an amount between about 0 to 30% by weight of the binder solids and ammonium sulfate in an amount between about 0 to 6% by weight of the binder solids and spraying said binder system onto said mineral fibers.

5. The process of claim 4, wherein the amonia is added to the binder system before the ammonium sulfate.

* * * * *

UNITED STATES PATENT AND TRADEMARK OFFICE

Certificate

Patent No. 4,294,879 Patented October 13, 1981

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Patricia A. McHenry and Richard L. Rhodes.

Signed and Sealed this Eighteenth Day of March 1986.

BRADLEY R. GARRIS,
*Office of the Deputy Assistant Commissioner for Patents.*

UNITED STATES PATENT AND TRADEMARK OFFICE

Certificate

Patent No. 4,294,879 Patented October 13, 1981

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Patricia A. McHenry and Richard L. Rhodes, Jr.

Signed and Sealed this Second Day of December, 1986.

BRADLEY R. GARRIS,
*Office of the Deputy Assistant Commissioner for Patents.*